US006979800B2

(12) United States Patent
Kohne et al.

(10) Patent No.: US 6,979,800 B2
(45) Date of Patent: Dec. 27, 2005

(54) HEATER

(75) Inventors: Jeffrey R. Kohne, Tualatin, OR (US); Barry D. Reeves, Lake Oswego, OR (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/839,306

(22) Filed: May 4, 2004

(65) Prior Publication Data

US 2005/0247690 A1 Nov. 10, 2005

(51) Int. Cl.[7] ..... H05B 1/00

(52) U.S. Cl. ..... 219/213; 219/216; 219/469; 219/542; 399/331

(58) Field of Search ..... 219/213, 216, 219/469, 470, 542, 548, 550; 399/331, 333, 399/334

(56) References Cited

U.S. PATENT DOCUMENTS

| | | | | |
|---|---|---|---|---|
| 5,614,933 | A * | 3/1997 | Hindman et al. | 347/103 |
| 6,713,728 | B1 * | 3/2004 | Justice et al. | 219/469 |
| 2004/0060921 | A1 | 4/2004 | Justice et al. | 219/469 |

* cited by examiner

*Primary Examiner*—Robin O. Evans
*Assistant Examiner*—Leonid M. Fastovsky
(74) *Attorney, Agent, or Firm*—Manuel Quiogue

(57) ABSTRACT

A heater including a plurality of first dielectric vanes and a plurality of second dielectric vanes arranged about a longitudinal axis, each first dielectric vane and second dielectric vane having a plurality of wire guiding grooves, a heater wire structure wound around the first and second dielectric vanes in wire guiding grooves, and wherein the heater wire structure substantially avoids contact with bottoms of the wire guiding grooves of the second dielectric vanes.

10 Claims, 7 Drawing Sheets

HEATER

BACKGROUND

The subject disclosure is generally directed to a heater that can be employed in printing apparatus such as printers, photocopiers, and multi-function devices.

Some printing technologies employ one or more heaters, for example to heat a print drum or a platen. As a specific example, a solid ink jet printing apparatus can include a heated print drum on which an image is formed pursuant to fluid drop jetting. The image is then transferred to an output print medium such as paper.

It can be difficult to implement a heater that is reliable.

DETAILED DESCRIPTION

Figure 1:
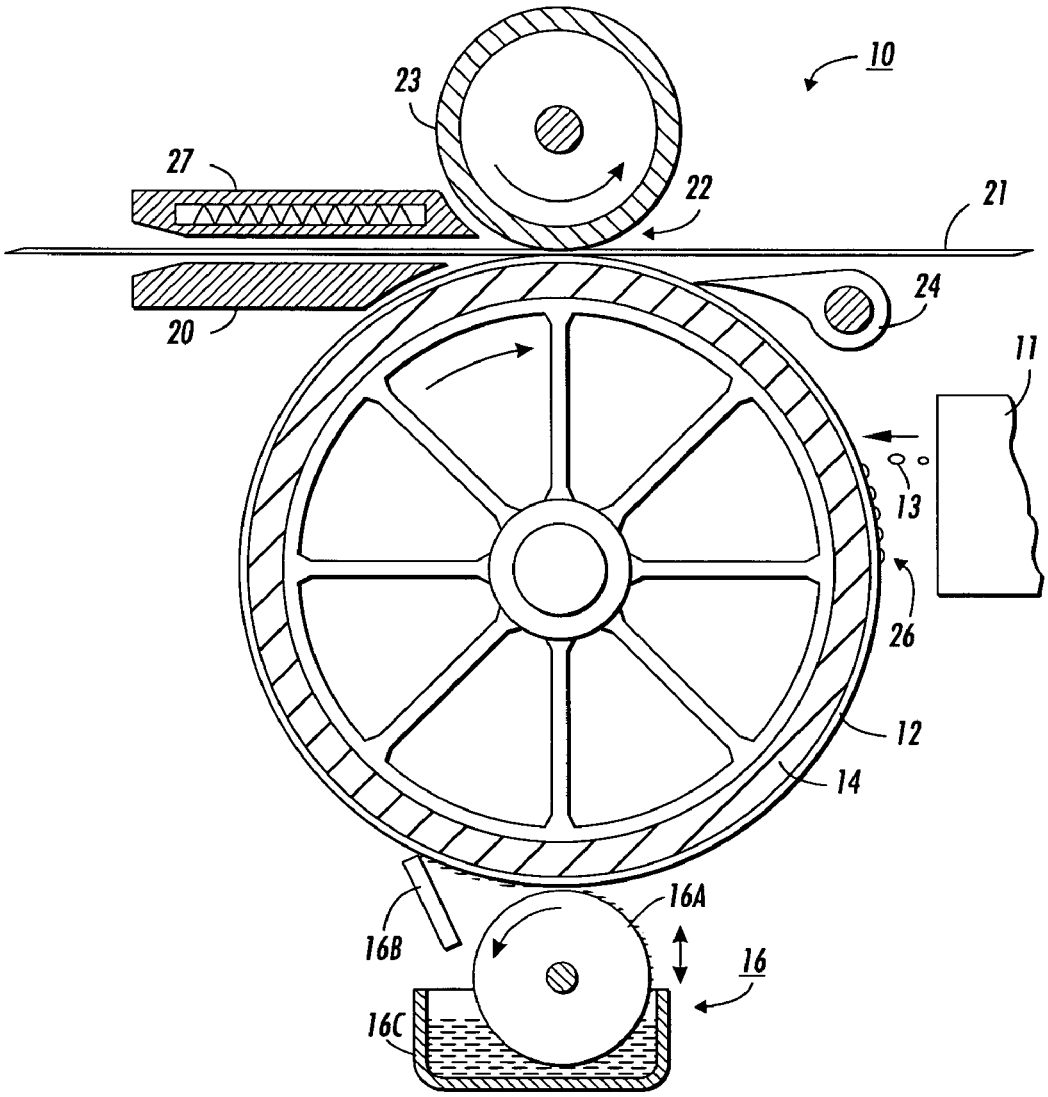
FIG. 1 is a schematic block diagram of an embodiment of a solid ink printing apparatus.

FIG. 1 is a schematic block diagram of an embodiment of a printing apparatus 10 in which a disclosed heater can be employed. The printing apparatus includes a printhead 11 that is appropriately supported for stationary or moving utilization to emit drops 13 of ink onto an intermediate transfer surface 12 applied to a supporting surface of a print drum 14. The ink can be melted solid or phase change ink, for example. The intermediate transfer surface 12 can be a liquid layer such as a functional oil that can be applied by contact with an applicator such as a roller 16A of an applicator assembly 16. By way of illustrative example, the applicator assembly 16 can include a metering blade 16B and a reservoir 16C. The applicator assembly 16 can be configured for selective engagement with the print drum 14.

The printing apparatus 10 further includes a substrate guide 20 and a media preheater 27 that guides a print media substrate 21, such as paper, through a nip 22 formed between opposing acutated surfaces of a roller 23 and the intermediate transfer surface 12 supported by the print drum 14. Stripper fingers 24 can be pivotally mounted to assist in removing the print medium substrate 21 from the intermediate transfer surface 12 after an image 26 comprising deposited ink drops is transferred to the print medium substrate 21.

FIGS. 2–7 schematically depict an embodiment of a heater that can be used to heat the print drum 14 of the printing apparatus 10 of FIG. 1. The drum heater can comprise a plurality of longitudinally extending dielectric wire guiding vanes 36, 37 angularly distributed about a central longitudinal axis CA, wherein each dielectric vane is positioned such that its transverse or width dimension extends radially relative to the central longitudinal axis. Each dielectric vane includes, for example, wire guiding grooves 39 along longitudinal edges that are radially furthest from the central axis CA. A wire structure comprising for example two side by side heater wires 62, 64 is spirally wound around the vanes 36, 37 such that the heater wires are generally between sides of the wire guiding grooves 39. Depending upon implementation, the heater wires 62, 64 can be of different diameters and/or resistivities, for example. The drum heater further includes wire retaining dielectric panels 67 attached to the dielectric vanes 36 adjacent the grooves 39, and end cap structures 70.

By way of illustrative example, the dielectric vanes 36 can be connected to each other in the vicinity of the central axis CA and form a cross in cross-section, such that the dielectric vanes can be angularly located about the central axis CA at about 90 degree intervals. The dielectric vanes 37 can be panels that are not fixedly connected to any other dielectric vane, and can be angularly located about the central axis at about 90 degree intervals. The dielectric vanes 36, 37 and the wire retaining dielectric panels 39 are held together by the end cap structures 70 which engage longitudinally separated end portions or tabs 36A of the dielectric vanes 36, longitudinally separated end portions or tabs 37A of the dielectric vanes 37, and longitudinally separated end portions 67A of the wire retaining dielectric panels 67, as well as by attachment of the wire retaining dielectric panels 67 to associated dielectric vanes 36, 37. The end tabs 36A of the vanes 36 can comprise for example integral tabs that are shared by radially opposed vanes 36.

Figure 5:
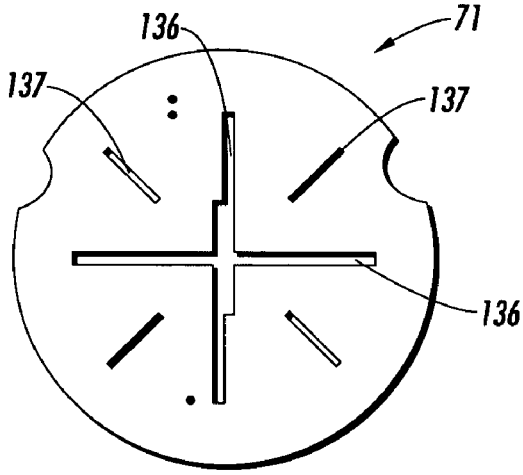
FIG. 5 is an elevational view of an embodiment of an inner panel of an end cap structure of the print drum heater of FIG. 2.
Figure 6:
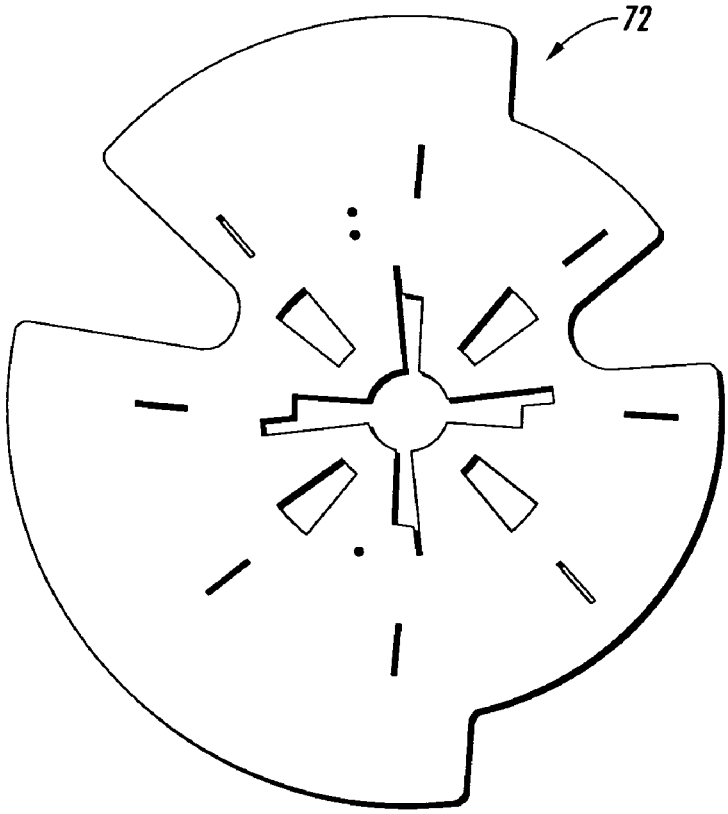
FIG. 6 is an elevational view of an embodiment of an intermediate panel of an end cap structure of the print drum heater of FIG. 2.
Figure 7:
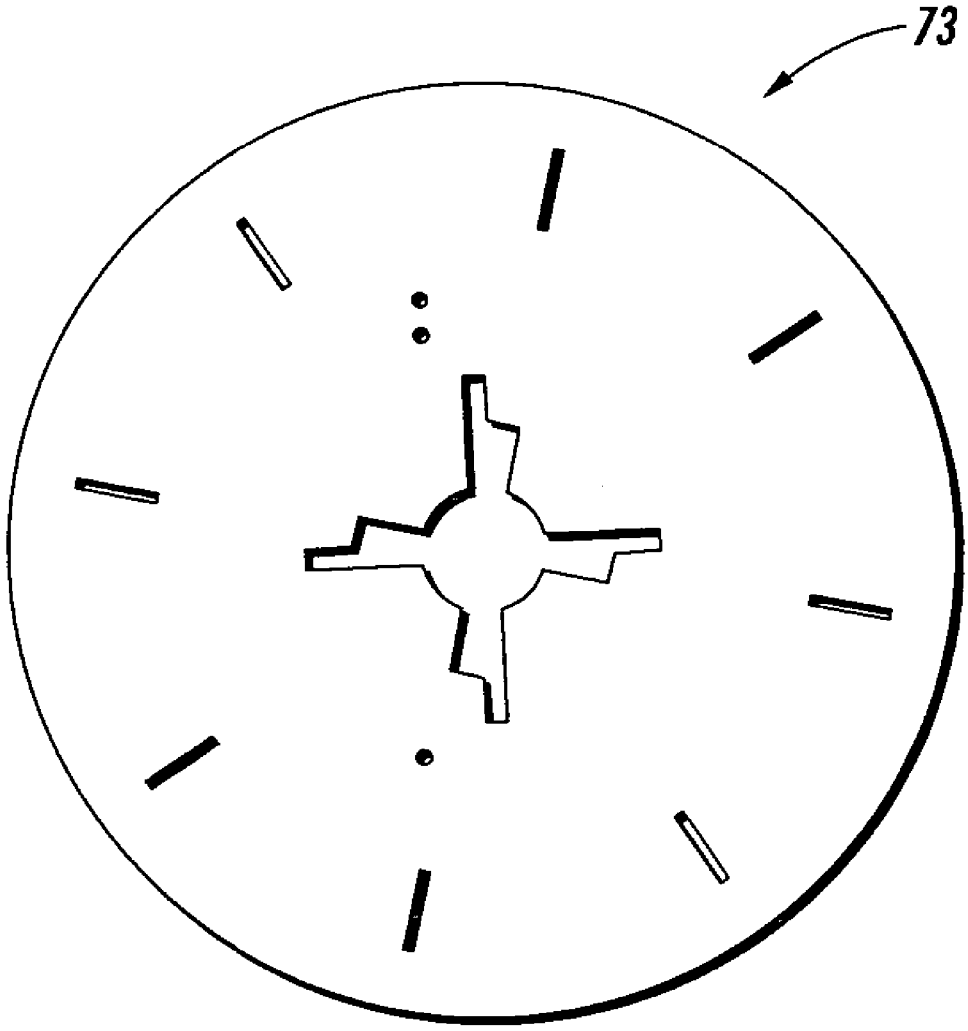
FIG. 7 is an elevational view of an embodiment of an outer panel of an end cap structure of the print drum heater of FIG. 2.

Each end cap structure 70 can comprise a plurality of panels, for example, and FIG. 5 schematically illustrates an embodiment of inner panel 71 of the end cap structure 70. FIG. 6 schematically illustrates an embodiment of an intermediate 72 panel of the end cap structure 70, and FIG. 7 schematically illustrates an embodiment of an outer panel 73 of the end cap structure 70.

Each inner panel 71 includes crossed slots 136 generally centered on the central axis CA for radially and angularly capturing the tabs 36A so that the dielectric vanes 36 are at 90 degree angular spacing. Each inner panel 71 further includes slots 137 for angularly capturing the tabs 37A such that each of the dielectric vanes 37 is angularly positioned between adjacent vanes 36, for example. The slots 137 have a radial extent that is greater than the radial extent of the tabs 37A, which allows the dielectric vanes 37 to be displaced radially while the intermediate and outer panels 72, 73 are not engaged with the tabs 36A, 37A, 67A. The intermediate panels 72 generally function to axially secure the inner panels 71 and the intermediate panels 72 onto the tabs 36A, and to generally locate the tabs 37A in their innermost radial position such that the dielectric vanes 37 are generally in their innermost radial position. The intermediate panels 72 further engage the tabs 67A of the wire retaining dielectric panels 67. The outer panels 73 also support and locate the end tabs 67A of the wire restraining dielectric panels 67, and axially secure the inner panels 71, the intermediate panels 72 and the outer panels 73 onto the tabs 36A. By way of illustrative example, the intermediate and outer panels 72, 73 are configured to be axially slipped over the tabs 36A and twisted to engage radial notches formed in the tabs 36A. The wire restraining dielectric panels 67 are attached to the protruding tabs of the dielectric vanes 36, 37 after the intermediate and outer panels are meshed and twisted onto the tabs 36A. The dielectric wire restraining panels 67 assist in maintaining the vanes 37 in a radially inward position when attached thereto.

Figure 3:
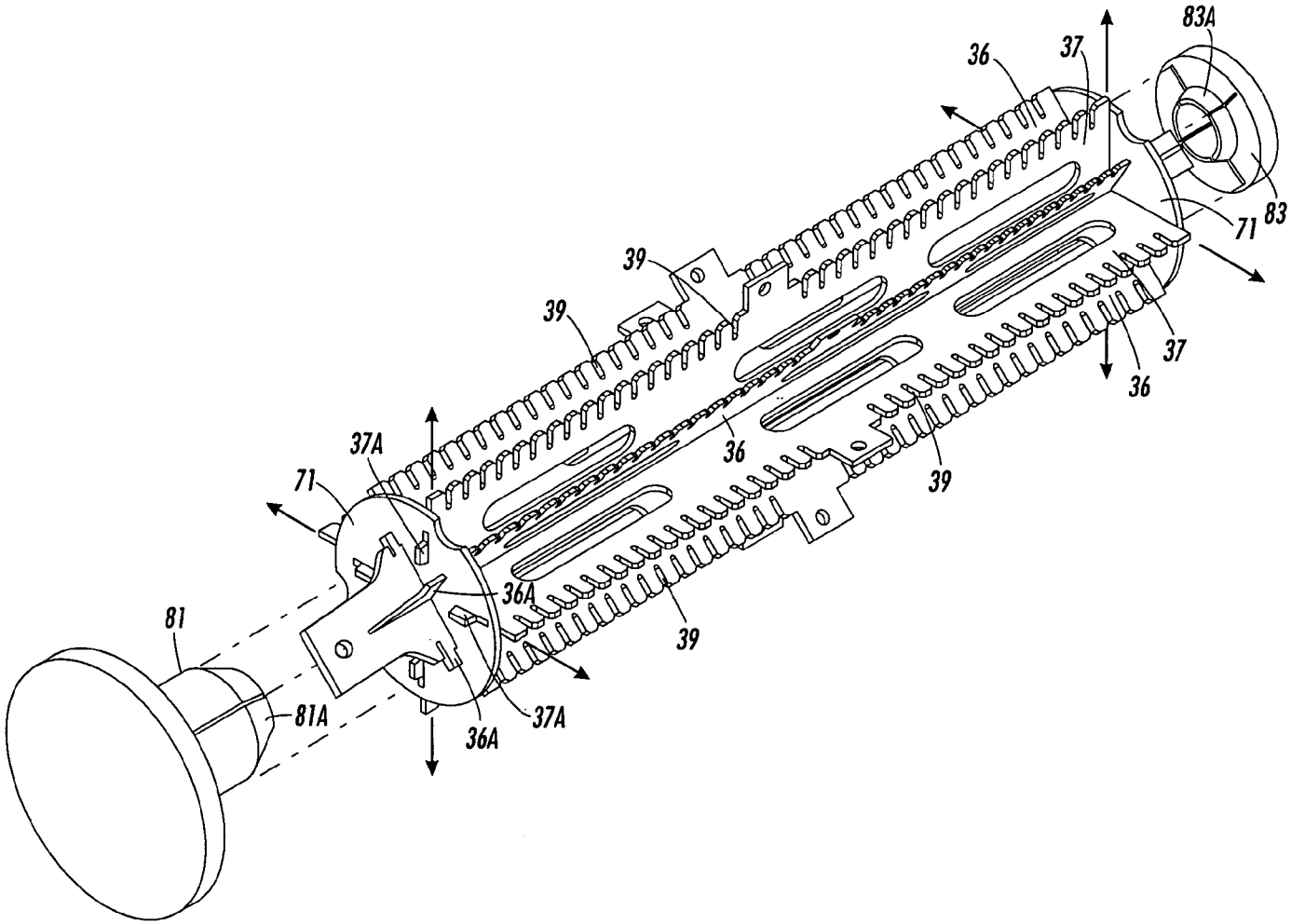
FIG. 3 is a schematic isometric view of an embodiment of an expandable frame portion of the print drum heater of FIG. 2.
Figure 4:
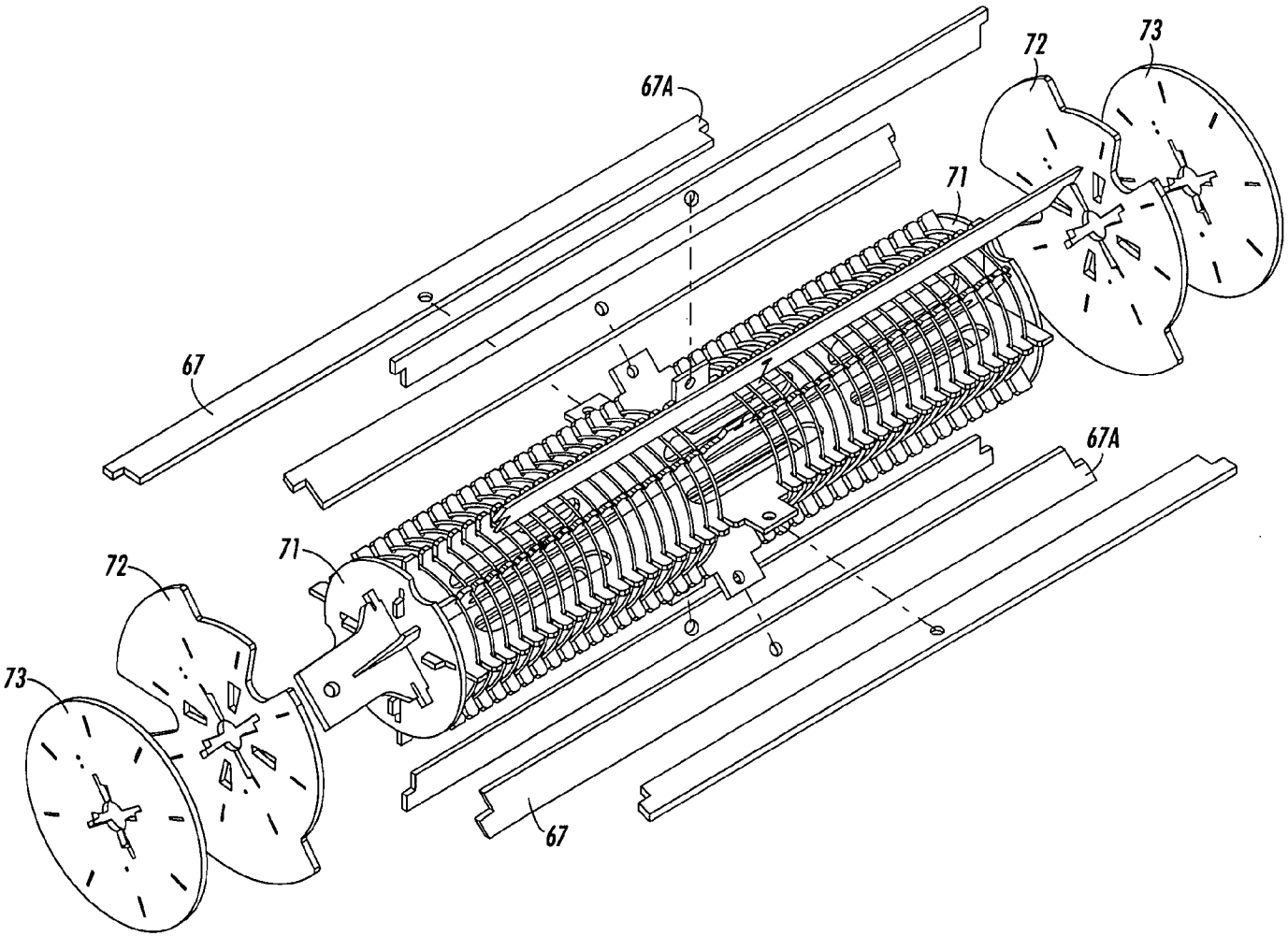
FIG. 4 is a schematic isometric view of the expandable frame portion of the print drum of FIG. 2 with a wire structure wound around the expandable frame portion.

Referring more particularly to FIG. 3, the dielectric vanes 36, 37 and the inner end panels 71 comprise an expandable frame wherein at least some of the dielectric vanes can be selectively displaced radially outwardly, for example by engagement of the tabs 37A with clamps 81, 83 that respectively include concial ramps 81A, 83A for pushing the tabs 37A outwardly.

By way of illustrative example, the dielectric vanes 36, 37 and the inner end panels 71 can be configured such that when the dielectric vanes 37 are in an outermost radial or expanded position, the bottoms of the wire guiding grooves 39 of the dielectric vanes 37 are further from the central axis than the bottoms of the wire guiding grooves of the dielectric vanes 36, and such that when the dielectric vanes 37 are in a radially innermost or retracted position, the bottoms of the wire guiding grooves of the dielectric vanes 37 are at substantially the same distance from the central axis CA as the bottoms of the wire guiding grooves 39 of the dielectric vanes 36. By way of specific example, the dielectric vanes 37 and the inner panels 71 can be configured such that the bottoms of the wire guiding grooves 39 of all of the dielectric vanes 36, 37 are substantially on an imaginary cylinder substantially centered on the central axis CA when the vanes 37 are in an innermost or retracted radial position, for example as determined by the slots 137 of the inner end panels 71 and such that the bottoms of the wire guiding grooves 39 of the dielectric vanes 37 are outside of such imaginary cylinder when the vanes 37 are in an outermost or expanded radial position, for as determined by the slots 137 of the inner end panels 71.

Alternatively, the dielectric vanes 36, 37 and the inner end panels 71 can be configured such that when the dielectric vanes 37 are in an outermost radial or expanded position, the bottoms of the wire guiding grooves 39 of the dielectric vanes 37 are at substantially the same distance from the central axis CA as the bottoms of the wire guiding grooves 39 of the dielectric vanes 36, and such that when the dielectric vanes 37 are in a radially innermost or retracted position, the bottoms of the wire guiding grooves 39 of the dielectric vanes 37 are closer to the central axis CA than the bottoms of the wire guiding grooves 39 of the dielectric vanes 36. By way of specific example, the dielectric vanes 36, 37 and the inner panels 71 can be configured such that the bottoms of the wire guiding grooves 39 of all of the dielectric vanes 36, 37 are substantially on an imaginary cylinder substantially centered on the central axis CA when the vanes 37 are in an outermost or expanded radial position, for example as determined by the slots 137 of the inner end panels 71 and such that the bottoms of the wire guiding grooves 39 of the dielectric vanes 37 are inside of such imaginary cylinder when the vanes 37 are in an innermost or retracted radial position, for as determined by the slots 137 of the inner end panels 71.

In manufacture, the dielectric vanes 36, 37 and the inner end panels 71 are assembled as an expandable frame that can be mounted in a coiling fixture that pushes on the tabs 37A to move the dielectric vanes 37 radially outwardly, for example to an outermost radial position as determined by the slots 137 of the inner end panels 71. Heater wire is then coiled into the wire guiding grooves 39 of the expanded frame such that the heater wire contacts substantially all of the bottoms of the wire guiding grooves 39, and the ends of the wire or wires are suitably secured to brackets attached to one or more of the dielectric vanes 36, for example. This generally fixes the shape of the wire structure. After removal of the coiled frame from the coiling fixture, the dielectric vanes 37 are retracted radially inwardly, for example to an innermost radial position as determined by the slots 137 of the inner end panels 71, and the wire retaining dielectric panels 67, the intermediate panels 72 and outer panels 73 are assembled with the coiled frame. The wire retaining panels 67 can then be attached to associated dielectric vanes 36, 37, which will prevent unlocking rotation of the intermediate and outer panels 72, 73.

Thus, in the assembled print drum heater, the dielectric vanes are in a radially retracted position and the bottoms of the wire guide grooves 39 of the dielectric vanes 37 are displaced from the coiled heater wire structure. This allows the heater wires 62, 64 to substantially avoid contact with bottoms of the wire guiding grooves of the dielectric vanes 37.

Figure 2:
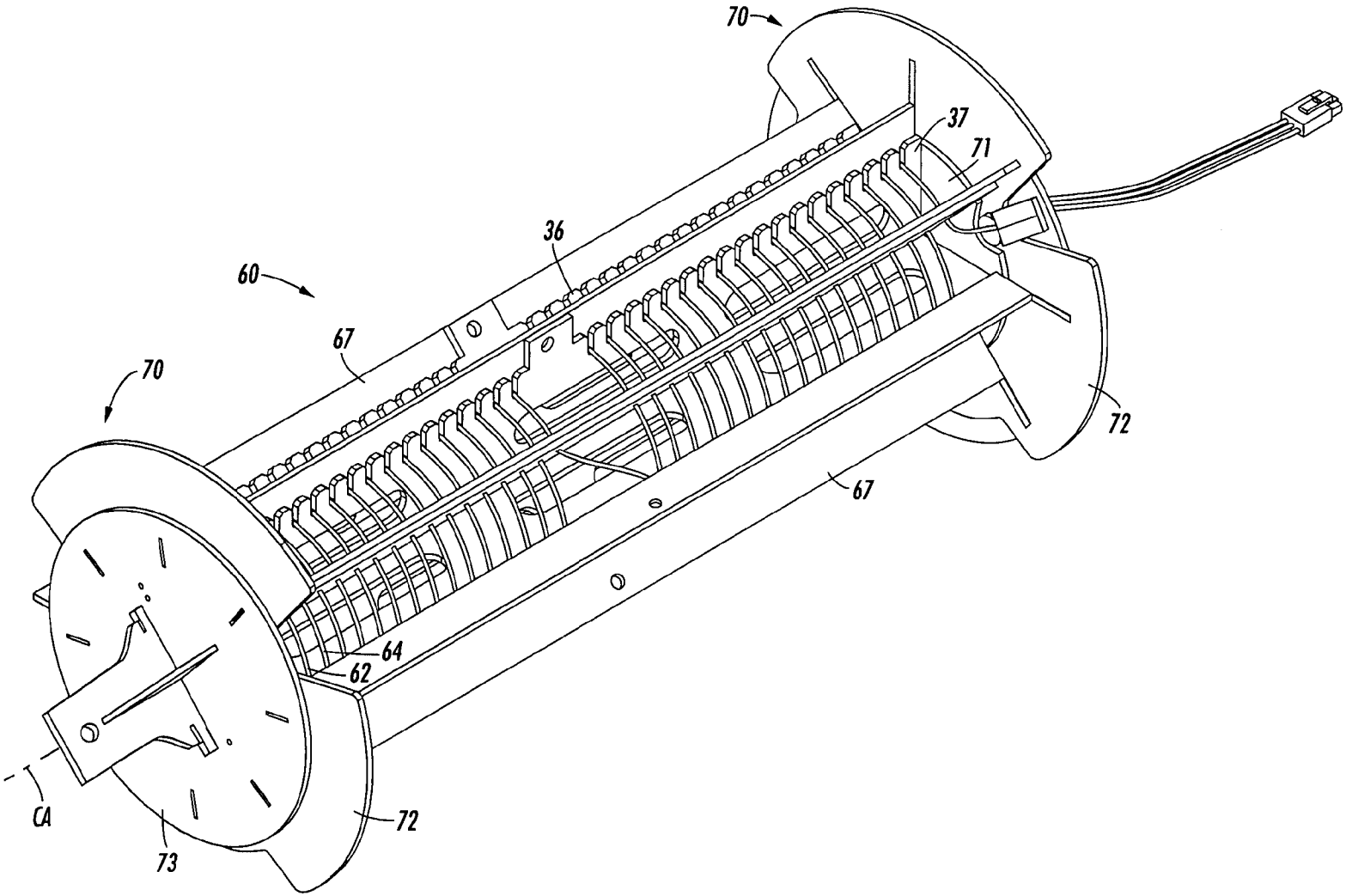
FIG. 2 is a schematic isometric view of an embodiment of a print drum heater.
Figure 8:
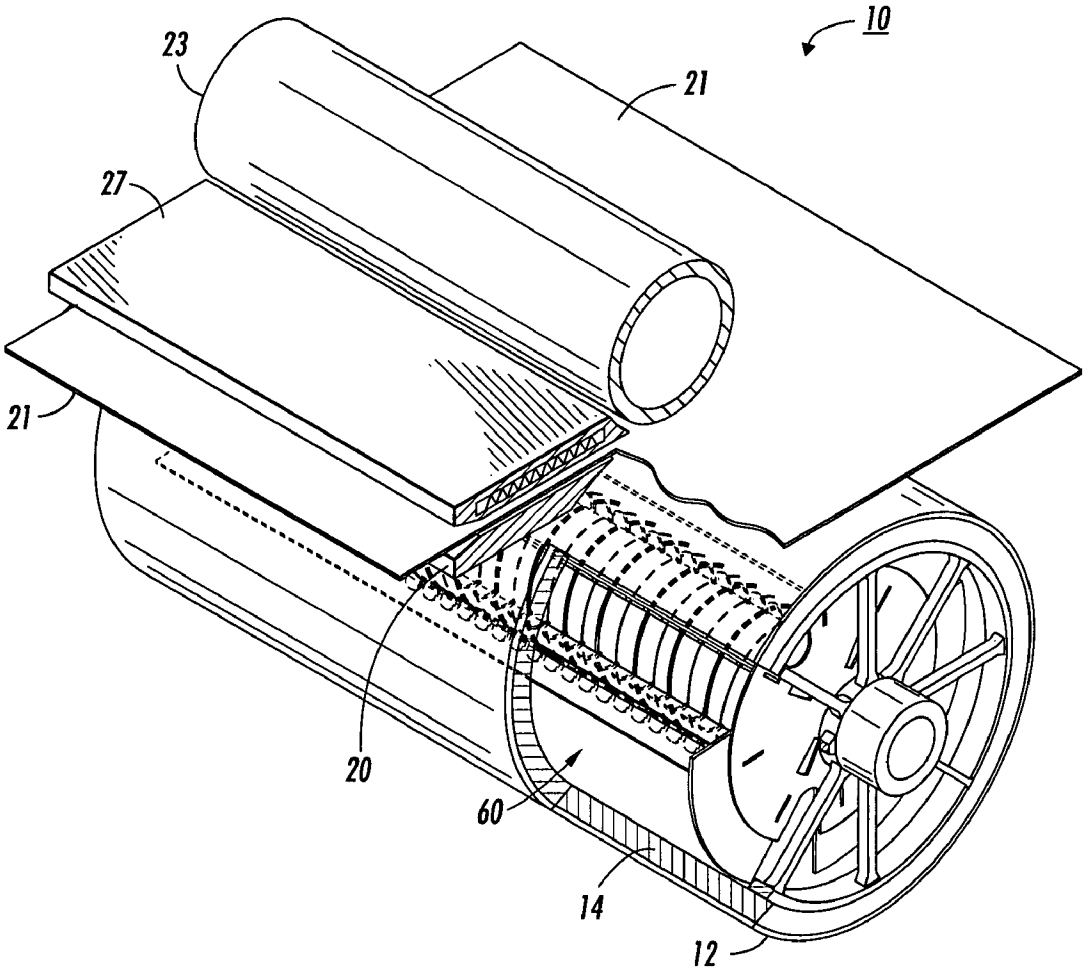
FIG. 8 illustrates a use of the print drum heater of FIG. 2 in the printing apparatus of FIG. 1.

FIG. 8 illustrates a use of the heater of FIG. 2 in the print drum 14 of the printing apparatus of FIG. 1.

The disclosed heater structure can be reliable as a result of reduced contact between the heater wire structure and the dielectric vanes, which can allow the heater wire structure to be generally unconstrained and able to move, lengthen and/or shorten pursuant to heating and cooling with reduced loading on the dielectric vanes. Also, the reduced contact between the heater wire structure and the dielectric vanes can reduce cold spots that can be detrimental to heater life.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A printing apparatus comprising:

a print drum;

a heater for heating the print drum and comprising a plurality of first dielectric vanes and a plurality of second dielectric vanes arranged about a longitudinal axis and a heater wire structure wound around the first and second dielectric vanes in wire guiding grooves of the first and second dielectric vanes; and wherein the heater wire structure and the second dielectric vanes are configured such that the heater wire structure substantially avoids contact with bottoms of the wire guiding grooves of the second dielectric vanes.

2. A printing apparatus comprising:

a print drum;

a heater for heating the print drum and comprising a plurality of dielectric wire guiding structures arranged about a longitudinal axis and a heater wire structure wound around the dielectric wire guiding structures in wire guiding grooves of the dielectric wire guiding structures; and wherein the heater wire structure and the dielectric wire guiding structures are configured such that the heater wire structure substantially avoids contact with at least some of the bottoms of the wire guiding grooves of the dielectric wire guiding structures.

3. The heater of claim 1 wherein the first dielectric vanes are angularly located at about 90 degree intervals.

4. The heater of claim 1 wherein the second dielectric vanes are angularly located at about 90 degree intervals.

5. The heater of claim 1 wherein the first dielectric vanes are angularly located at about 90 degree intervals, and wherein the second dielectric vanes are angularly located at about 90 degree intervals.

6. The heater of claim 1 wherein the bottoms of the wire guide grooves of the first dielectric vanes and the bottoms of the wire guide grooves of the second dielectric vanes are at substantially the same distance from the longitudinal axis.

7. The heater of claim 1 wherein bottoms of the wire guiding grooves of the first dielectric vanes are radially located further from the longitudinal axis than bottoms of the wire guiding grooves of the second dielectric vanes.

8. The heater of claim 1 further including end panels for radially locating the second dielectric vanes.

9. The heater of claim 1 further including wire retaining dielectric panels attached to the first dielectric vanes and the second dielectric vanes.

10. The heater of claim 1 wherein the heater wire structure comprises two heater wires.

* * * * *